US005667431A

United States Patent [19]

Mortin

[11] Patent Number: 5,667,431

[45] Date of Patent: Sep. 16, 1997

[54] DISHWASHER MACHINE

[75] Inventor: Bo S. Mortin, Malmö, Sweden

[73] Assignee: Aktiebolaget Electrolux, Stockholm, Sweden

[21] Appl. No.: 313,320

[22] PCT Filed: Apr. 8, 1993

[86] PCT No.: PCT/SE93/00315

§ 371 Date: Dec. 7, 1994

§ 102(e) Date: Dec. 7, 1994

[87] PCT Pub. No.: WO93/20739

PCT Pub. Date: Oct. 28, 1993

[30] Foreign Application Priority Data

Apr. 8, 1992 [SE] Sweden ..... 9201117

[51] Int. Cl.[6] ..... B24C 3/04

[52] U.S. Cl. ..... 451/88; 451/89

[58] Field of Search ..... 451/87, 88, 89, 451/99, 66

[56] References Cited

U.S. PATENT DOCUMENTS

| | | | |
|---|---|---|---|
| 1,761,492 | 6/1930 | Reily . | |
| 2,395,160 | 2/1946 | Anderson | 451/89 |
| 3,012,262 | 12/1961 | Mori | 451/99 |
| 3,323,159 | 6/1967 | Ummel et al. | 15/3 |
| 3,455,062 | 7/1969 | Eppler | 451/88 |
| 3,553,895 | 1/1971 | Power | 451/87 |
| 4,374,443 | 2/1983 | Mosell | 134/7 |
| 4,959,930 | 10/1990 | Tsutsumi | 451/89 |

FOREIGN PATENT DOCUMENTS

| | | |
|---|---|---|
| 1220095 | 6/1966 | Germany . |
| 464387 | 4/1991 | Sweden . |
| 9200639 | 10/1993 | Sweden . |
| WO92/15237 | 9/1992 | WIPO . |

*Primary Examiner*—Robert A. Rose

*Attorney, Agent, or Firm*—Beveridge, DeGrandi, Weilacher & Young, L.L.P.

[57] ABSTRACT

A dishwasher comprises a dishwashing tank (1) with a compartment (10) for receiving articles to be washed (2), and a magazine (3,4) provided below this compartment for receiving washing liquid and blasting agent. The washing liquid and the blasting agent have different densities. Between the magazine and the compartment extends a conduit (5, 9, 11) in which a pump (6) is connected for delivering washing liquid and blasting agent under elevated pressure to a nozzle arrangement (8) mounted at the conduit end disposed in the compartment receiving the articles to be washed. Washing liquid and blasting agent discharged from the nozzle arrangement impinge upon the articles to be washed, to subsequently drop into the magazine via an outlet (13) from the compartment. A partition (12) divides the magazine into a first chamber (3) situated straight below the outlet (13) from the compartment (10) and adapted to receive washing liquid and blasting agent, and a second chamber (4) situated beside the outlet and communicating with the first chamber via a passage (14) which, owing to the different densities of the washing liquid and the blasting agent, permits only washing liquid to flow from the first chamber to the second chamber. The suction side of the pump is connected to the second chamber. A means (7) for supplying blasting agent is connected between the first chamber (3) and the conduit (9) in order to supply blasting agent to the washing liquid.

21 Claims, 2 Drawing Sheets

DISHWASHER MACHINE

Figure 1:
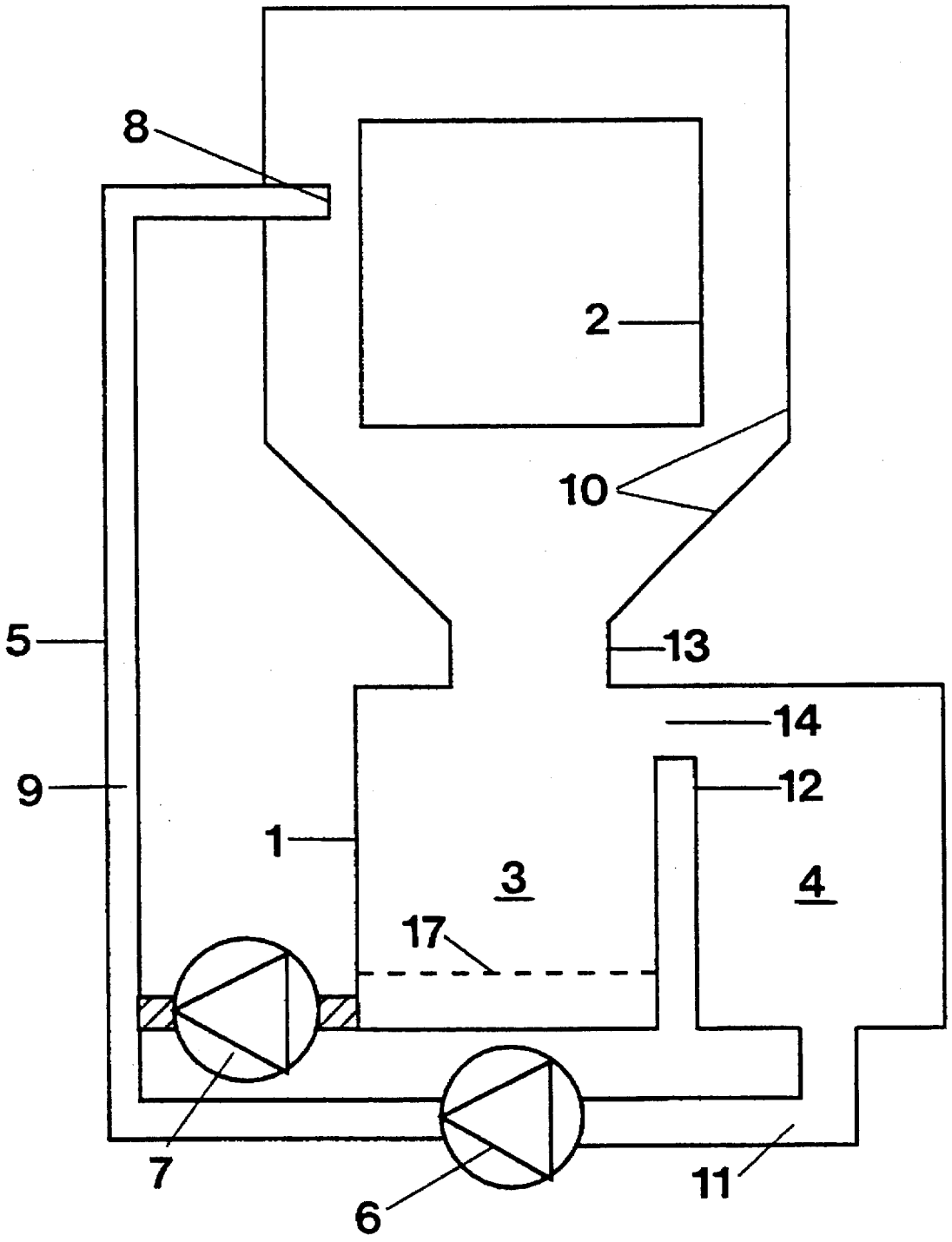

The present invention relates to a dishwasher comprising a dishwashing tank with a compartment for receiving articles to be washed, and a magazine for receiving washing liquid and blasting agent, the washing liquid and the blasting agent having different densities; and a conduit which extends between said magazine and said compartment and in which a pump is connected for delivering washing liquid and blasting agent under elevated pressure to a nozzle arrangement mounted at the conduit end disposed in the compartment receiving the articles to be washed, washing liquid and blasting agent discharged from the nozzle arrangement impinging upon the articles to be washed, to subsequently drop into the magazine via an outlet from said compartment. The invention also concerns a blasting agent.

Heavy-duty dishwashers, primarily used in catering departments, are long since known, and are based on the idea of spraying under high presure a mixture of washing water and blasting agent towards the articles to be washed. The cleaning principle of the machine is as follows. First, the articles to be washed are fixed in a suitable device in the washing compartment. The washing process is begun by a pump pumping washing water with no blasting agent added. When the washing water has attained a suitable pressure and flow, blasting agent is added by the pump drawing a mixture of washing water and blasting agent from a magazine provided straight below the washing compartment. After washing, the pump draws only washing water for rinsing the washed articles, e.g. by sucking water from an elevated level in the tank, where the comparatively heavy blasting agent is not present. After rinsing with the washing water in the magazine, the articles are rinsed with fresh water to which a minor amount of a rinsing agent/drying agent has been added. When the whole washing operation is completed, the washing water is in most cases conducted to a strainer means for separating the blasting agent bodies from the washing water and collecting them in the lower part of the magazine to be used once more in the subsequent washing operation.

Prior-art heavy-duty dishwashers suffer from the drawback that the tank or magazine for receiving washing water and blasting agent from the dishwashing compartment is located straight below this compartment. This produces turbulence in the magazine, which in turn may cause the pump to draw air and thus make the dishwasher operate irregularly. Further, it is difficult to control the amount of blasting agent in the washing water pumped through the conduit to the nozzle arrangement in the dishwashing compartment. Neither is it possible to increase the amount or the degree of admixture of blasting agent while maintaining the capacity of the pump. Today's heavy-duty dishwashers have a tendency to attain only a 90% cleaning degree during the time at disposal. The normal washing time in a dishwashing programme is about 5 min. In order to obtain a 100% cleaning degree, that time would have to be prolonged to 15–20 min in prior-art dishwashers.

A primary object of the invention is to obviate the drawback of uneven operation, and an additional object is to increase the efficiency of the dishwasher.

These objects are achieved by a dishwasher which is of the type mentioned by way of introduction and which exhibits the features recited in the characterising clauses of appended claims 1 and 3.

Figure 2:
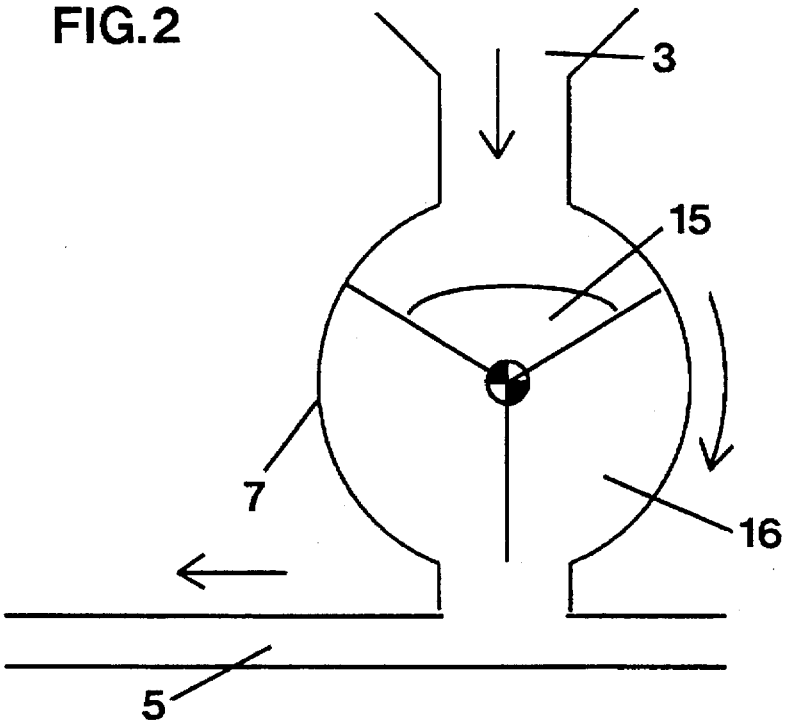
Figure 3:
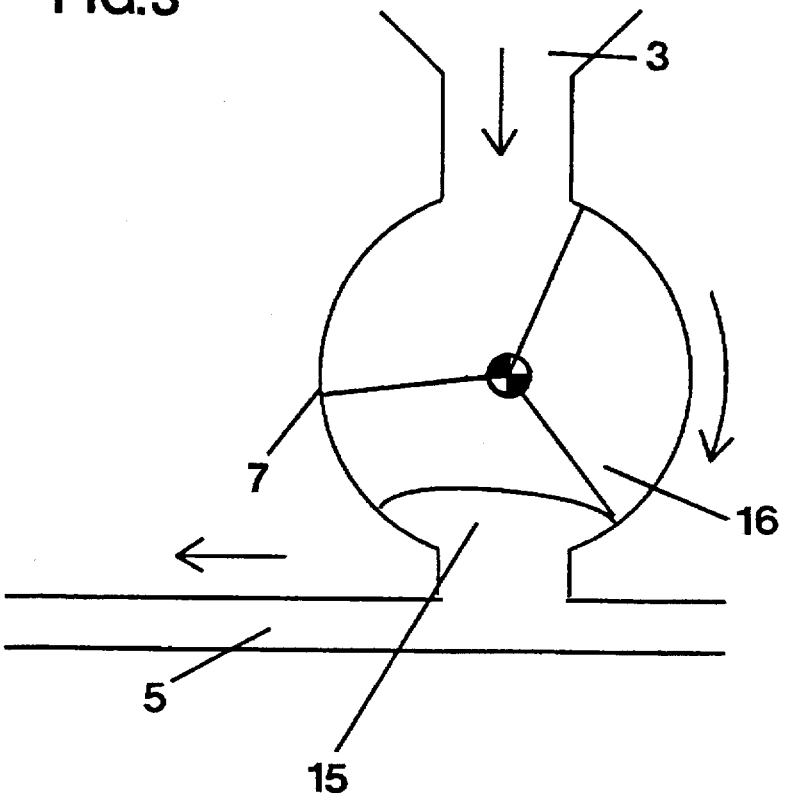

Embodiments of the invention will be described in more detail below with reference to the accompanying drawings, in which FIG. 1 schematically illustrates a first embodiment of the dishwasher according to the invention; and FIGS. 2 and 3 show how blasting agent can be forced into the washing water conduit.

FIG. 1 schematically illustrates a first embodiment of the dishwasher according to the invention. The dishwasher has a dishwashing tank 1 with an upper compartment 10 for receiving articles to be washed 2, and a lower magazine 3, 4 for receiving washing liquid, normally water, and a blasting agent. A partition 12 divides the magazine into a first chamber 3 and a second chamber 4 which communicate with one another via a passage 14 arranged between the ceiling of the magazine and the upper portion of the partition 12. In the first chamber, there is a strainer allowing blasting agent to pass but not any large-size objects that may drop down from the compartment 10 through an outlet 13. A conduit 5 runs between the second chamber 4 and the compartment 10. The conduit end located in the compartment 10 has a nozzle arrangement 8 adapted to spray the mixture of blasting agent and washing water towards the articles to be washed 2 under high pressure. A pump 6 is connected in the conduit 5, which it divides into a delivery line 9 and a suction line 11. The suction line is connected to the second chamber 4. A means 7 for supplying blasting agent is connected between the first chamber 3 and the delivery line 9. Preferably, this supply means is an impeller pump adapted to pump the mixture of blasting agent and washing water from the first chamber 3 into the delivery line 9 while the pump 6 is pumping washing water through this line. By controlling the impeller pump, the amount of blasting agent supplied to the conduit 5 can be adjusted without altering the mode of operation of the pump 6. Use is preferably made of an impeller pump, since such a pump is able to withstand the back pressure which the mixture of blasting agent and washing water encounters when pressed into the delivery line 9. As a result, the water is prevented from flowing back through the supply means, and the impeller pump thus serves as a non-return valve.

FIGS. 2 and 3 illustrate the operation of the impeller pump. The mixture 15 of blasting agent and water is moved by the vanes through the closed chamber 16 of the pump housing, to be forced into the delivery line 9.

Returning now to FIG. 1, the positions of the chambers 3 and 4 are essential in order to achieve the aimed-at uniform operation of the dishwasher. Washing water and blasting agent falling through the outlet 13 into the first chamber 3 collect therein, so that blasting agent descends through the strainer 17 to the supply means 7. When enough water has accummulated in the chamber 3, water will flow over into the chamber 4 via the passage 14. Since the chamber 4 is located beside the outlet 13 from the dishwashing compartment, the risk of turbulence is much smaller in this chamber than in the first chamber 3. This arrangement considerably reduces the risk of the pump drawing air from the chamber 4, thereby ensuring uniform operation of the pump and, consequently, of the dishwasher.

The embodiment shown in FIG. 1 implies that the blasting agent has higher density than the washing water. However, the invention also applies to the case of a lighter blasting agent, i.e. a blasting agent floating in water. Then, use is made of a construction in which the passage 14 is located at the bottom of the magazine and the supply means is located in the upper portion of the magazine, close to the outlet 13. Further, the conduit 5 may be branched, ending in a number of nozzles in the compartment 10. Finally, the supply means 7 may be connected to the suction line 11.

A variant of the inventive dishwasher utilises a twin-pump system. Such a system comprises two circuits with the pump conduit and the supply means connected to the same circuit.

The pressure in the conduit and the controlled forced feed of blasting agent make it posssible to considerably increase the amount of admixed blasting agent compared with the prior art, in which the pump, with the negative pressure in the suction line, delivers blasting agent from the magazine to the pump. Tests have shown that forced supply of blasting agent may result in a degree of admixture of 30% blasting agent, whereas prior-art dishwashers are only able to attain a degree of admixture of 6–9%. Furthermore, as a result of the controlled supply, the amount supplied can be adjusted afterwards, thereby optimising the degree of admixture according to the desired blasting agent.

To further improve the pump flow on the delivery side, air can be added at the suction side by self-priming or injection in a suitable amount. The air is finely divided in the pump and creates turbulence in the delivery line. The turbulence has a positive effect on the ability to carry the blasting agent, and thus has a positive effect on the degree of admixture.

The degree of admixture can be further increased by using smaller blasting agent particles. It is further advantageous to use blasting agents of different particle sizes and densities. The admixture of such an integral blasting agent has a sublimation effect further increasing the degree of admixture. Moreover, the smaller particle size affects the number of impingements on the articles to be washed, this number being directly proportional to the washing time. Finally, it should be mentioned that the particle asymmetry affects the transport ability by having a positive effect on the turbulence in the delivery line.

I claim:

1. A dishwasher comprising a dishwashing tank with a compartment for receiving articles to be washed, and a magazine provided below said compartment for receiving washing liquid and blasting agent, the washing liquid and the blasting agent having different densities; and a conduit which extends between said magazine and said compartment, said conduit having an outlet end provided with a nozzle arrangement which is disposed in the compartment, a pump connected in said conduit for delivering washing liquid and blasting agent under elevated pressure to said nozzle arrangement so that washing liquid and blasting agent are discharged from the nozzle arrangement and impinge upon the articles to be washed, said compartment having an outlet through which the washing liquid and blasting agent subsequently drop into the magazine, a partition dividing the magazine into a first chamber situated straight below the outlet from said compartment and adapted to receive washing liquid and blasting agent, and a second chamber situated beside the outlet, a passage communicating the first chamber with the second chamber, said passage due to the different densities of the washing liquid and the blasting agent permitting only washing liquid to flow from the first chamber to the second chamber; said pump having a suction side connected to the second chamber; and a supply means operatively independent of the pump for supplying blasting agent between the first chamber and the conduit in order to supply blasting agent to the washing liquid, said supply means for supplying blasting agent being operable to force a mixture of blasting agent and washing liquid from the first chamber into the conduit.

2. A dishwasher as claimed in claim 1 for use with a blasting agent which is heavier than the washing liquid, said partition having an upper portion, said magazine having a ceiling, and the passage is defined between the upper portion of the partition and the ceiling of the magazine, so that washing liquid can flow over the partition into the second chamber.

3. A dishwasher as claimed in claim 1, wherein the supply means for supplying blasting agent forces the mixture into the conduit while the pump is operating.

4. A dishwasher as claimed in claim 1, wherein the pump has a delivery side to which said supply means for supplying blasting agent is connected.

5. A dishwasher as claimed in claim 1, wherein the pump has a suction side to which said supply means for supplying blasting agent is connected.

6. A dishwasher as claimed in claim 1, wherein the supply means for supplying blasting agent is a positive displacement pump.

7. A dishwasher comprising a dishwashing tank with a compartment for receiving articles to be washed, and a magazine provided below said compartment for receiving washing liquid and blasting agent; a conduit which extends between said magazine and said compartment, said conduit having an outlet end provided with a nozzle arrangement which is disposed in the compartment, a pump connected in said conduit for delivering washing liquid and blasting agent under elevated pressure to said nozzle arrangement so that washing liquid and blasting agent are discharged from the nozzle arrangement and impinge upon the articles to be washed, said compartment having an outlet through which the washing liquid and blasting agent subsequently drop into the magazine, supply means operatively independent of the pump for supplying blasting agent and forcing a mixture of blasting agent and washing liquid from the magazine into the conduit.

8. A dishwasher as claimed in claim 7, wherein the supply means for supplying blasting agent forces the mixture into the conduit while the pump is operating.

9. A dishwasher as claimed in claim 7, wherein the pump has a delivery side to which said supply means for supplying blasting agent is connected.

10. A dishwasher as claimed in claim 7, where the pump has a suction side to which said supply means for supplying blasting agent is connected.

11. A dishwasher as claimed in claim 7, wherein supply means for supplying blasting agent is a positive displacement pump.

12. A dishwasher as claimed in claim 2, wherein the supply means for supplying blasting agent is operable to force a mixture of blasting agent and washing liquid from the first chamber into the conduit.

13. A dishwasher as claimed in claim 3, wherein the pump has a delivery side to which said supply means for supplying blasting agent is connected.

14. A dishwasher as claimed in claim 3, wherein the pump has a suction side to which said supply means for supplying blasting agent is connected.

15. A dishwasher as claimed in claim 3, wherein the supply means for supplying blasting agent is a positive displacement pump.

16. A dishwasher as claimed in claim 8, wherein the pump has a delivery side to which said supply means for supplying blasting agent is connected.

17. A dishwasher as claimed in claim 8, where the pump has a suction side to which said supply means for supplying blasting agent is connected.

18. A dishwasher according to claim 1, wherein said supply means is controllable independently of said pump to adjust the amount of blasting agent and washing liquid forced by said supply means into the conduit.

19. A dishwasher as claimed in claim 18 wherein the supply means includes a pump.

20. A dishwasher according to claim 7 wherein said supply means is controllable independently of said pump to adjust the amount of blasting agent and washing liquid forced by said supply means into the conduit.

21. A dishwasher according to claim 20 wherein said supply means includes a pump.

* * * * *